US009671095B1

(12) United States Patent
Sorensen et al.

(10) Patent No.: US 9,671,095 B1
(45) Date of Patent: Jun. 6, 2017

(54) LIGHTING SYSTEM CONFIGURED FOR MOUNTING WITH A CEILING SUPPORT GRID AND METHOD OF INSTALLATION

(71) Applicant: Litetronics International, Inc., Harvey, IL (US)

(72) Inventors: Robert Sorensen, Harvey, IL (US); Raghu Rao, Romeoville, IL (US)

(73) Assignee: Litetronics International, Inc., Bedford Park, IL (US)

( * ) Notice: Subject to any disclaimer, the term of this patent is extended or adjusted under 35 U.S.C. 154(b) by 0 days.

(21) Appl. No.: 15/368,541

(22) Filed: Dec. 2, 2016

(51) Int. Cl.

| | |
|---|---|
| ***F21V 21/04*** | (2006.01) |
| ***E04B 9/00*** | (2006.01) |
| ***F21S 8/02*** | (2006.01) |
| ***F21V 23/00*** | (2015.01) |
| ***F21V 17/10*** | (2006.01) |
| *F21Y 115/10* | (2016.01) |

(52) U.S. Cl.
CPC ..... *F21V 21/042* (2013.01); *F21S 8/026* (2013.01); *F21V 17/105* (2013.01); *F21V 23/003* (2013.01); *E04B 9/006* (2013.01); *F21Y 2115/10* (2016.08)

(58) Field of Classification Search
CPC .. E04B 9/08; E04B 9/006; E04B 9/205; F21S 8/026
See application file for complete search history.

(56) References Cited

U.S. PATENT DOCUMENTS 2,852,663 A * 9/1958 Stuffer ..... F21V 17/101 292/145
2,961,530 A * 11/1960 Garnett ..... F21S 8/02 362/311.03
3,019,333 A * 1/1962 Pascucci ..... F21S 8/02 220/3.8
3,308,288 A * 3/1967 Ades ..... E04B 9/006 362/150
3,545,145 A * 12/1970 Yousefpor ..... E04B 9/003 362/150
3,810,085 A * 5/1974 Woloski ..... F21S 8/02 362/277
3,816,880 A * 6/1974 Jacobs ..... E04B 9/006 362/150
4,171,535 A * 10/1979 Westermann ..... F21S 8/02 362/148
4,188,656 A * 2/1980 Howard ..... F21V 21/04 362/365
4,613,929 A * 9/1986 Totten ..... F21S 8/02 362/148
4,967,324 A * 10/1990 Barclay ..... F21V 21/04 362/147
5,564,815 A * 10/1996 Littman ..... F21S 8/028 362/147

(Continued)

*Primary Examiner* — Rodney Mintz
(74) *Attorney, Agent, or Firm* — Witters & Associates; Steve Witters

(57) ABSTRACT

Technologies are described for a lighting system configured to be mounted with a ceiling support grid and a method of installation. The lighting system has a rectangular or square mounting frame configured to transform its outer perimeter from a first outer perimeter to a second outer perimeter, enabling it to be inserted into a ceiling grid and to be held therein. The lighting system has an LED light source configured to be held with the mounting frame.

18 Claims, 9 Drawing Sheets

(56) References Cited

U.S. PATENT DOCUMENTS

| | | | | | |
|---|---|---|---|---|---|
| 5,997,158 | A * | 12/1999 | Fischer | F21S 8/04 | 362/364 |
| 6,059,424 | A * | 5/2000 | Kotloff | F21V 17/107 | 362/220 |
| 6,231,213 | B1 * | 5/2001 | Schmidt | F21S 8/02 | 362/374 |
| 7,413,323 | B2 * | 8/2008 | Lippis | E04B 9/0478 | 362/147 |
| 8,556,453 | B1 * | 10/2013 | Crane | F21S 8/026 | 362/217.01 |
| 8,894,232 | B2 * | 11/2014 | Caferro | F21V 29/004 | 362/148 |
| 9,206,948 | B1 * | 12/2015 | Scribante | F21V 21/03 | |
| 9,488,348 | B2 * | 11/2016 | Scribante | F21S 8/026 | |
| 2009/0196024 | A1 * | 8/2009 | Heiking | F21S 8/026 | 362/150 |
| 2010/0142202 | A1 * | 6/2010 | Sugishita | F21S 8/026 | 362/235 |
| 2011/0103042 | A1 * | 5/2011 | Tirrell | E04B 9/006 | 362/147 |
| 2013/0027915 | A1 * | 1/2013 | Caferro | F21V 29/004 | 362/147 |
| 2013/0027916 | A1 * | 1/2013 | Caferro | F21V 29/004 | 362/147 |
| 2013/0223100 | A1 * | 8/2013 | Caferro | F21V 29/004 | 362/612 |
| 2013/0235568 | A1 * | 9/2013 | Green | F21V 17/18 | 362/218 |
| 2015/0267873 | A1 * | 9/2015 | Price | F21V 21/03 | 362/235 |
| 2015/0276125 | A1 * | 10/2015 | Pratt | F21S 2/005 | 362/217.15 |
| 2016/0356430 | A1 * | 12/2016 | Stratas | F21S 8/04 | |

* cited by examiner

LIGHTING SYSTEM CONFIGURED FOR MOUNTING WITH A CEILING SUPPORT GRID AND METHOD OF INSTALLATION

FIELD OF THE DISCLOSURE

This invention generally relates to a lighting system for mounting a light source to a ceiling support grid, such as a false ceiling having ceiling tiles supported with a ceiling support grid.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Ceiling support grids and ceiling panels are very common in the office buildings where ceilings are constructed over open floor plan interior designs, such as cubicles. Such ceiling are popular in other commercial, industrial and domestic environments, including and not limited to hotels, meeting rooms, recreation rooms and other types of rooms or constructions which require removable ceilings for access to utilities (heating, air conditioning, water) that are concealed in the space between the drop ceiling tiles and the structural ceiling of the room. Such ceiling systems are well suited for use in old office buildings with high ceilings and with ceilings that are curved or arched. Typically, ceiling panels may be installed from beneath the ceiling support grid.

Typical luminaires installed in ceiling support grids may have a troffer with one or more tube lamps held therein. The luminaire may be placed on the ceiling support grid to have the light from the lamps directed downward through a space in the ceiling support grid having a ceiling panel removed. A lens, such as a diffusing lens or diffuser, or louver may be placed about the light opening in the ceiling support grid.

It is often desired to place, replace, or retrofit light sources on a ceiling support grid.

SUMMARY

In at least one embodiment of the present disclosure, a lighting system configured to be mounted with a ceiling grid is presently disclosed. The ceiling support grid comprises at least one rectangular or square grid opening with a first longitudinal flange extending inward from a first side and a second longitudinal flange extending inward from a second side. The first flange and the second flange are parallel with one another. The lighting system comprises a rectangular or square mounting frame configured to transform its outer perimeter from a first outer perimeter to a second outer perimeter. The first outer perimeter has at least one holder and enables the mounting frame to fit into the ceiling support grid and have the at least one holder cooperate with the first longitudinal flange. The second outer perimeter enables the mounting frame to cooperate with the second longitudinal flange and to be held with the ceiling support grid. The lighting system also comprises a rectangular or square light LED light source configured to be held to the mounting frame. The LED light source has at least one extension extending from a first longitudinal edge and at least one clasp on a second longitudinal edge, wherein the first longitudinal edge and the second longitudinal edge are parallel. The at least one extension is configured to cooperate with the mounting frame and the at least one clasp is configured to clasp with the mounting frame.

In at least one other embodiment of the present disclosure, a lighting system configured to be mounted with a ceiling grid comprises a rectangular or square mounting frame configured to be mounted in the rectangular or square grid opening in a ceiling support grid. The ceiling support grid comprises at least one rectangular or square grid opening with a first longitudinal flange extending inward from a first side and a second longitudinal flange extending inward from a second side, wherein the first flange and the second flange are parallel with one another. The lighting system comprises a rectangular or square LED light source configured to be held to the mounting frame comprising at least one extension extending beyond a first longitudinal edge, at least one clasp on a second longitudinal edge, wherein the first longitudinal edge and the second longitudinal edge are parallel, the at least one extension is configured to hang the LED light source from the mounting frame and to pivot it about the at least one extension, and the at least one clasp being configured to clasp with the mounting frame and hold the LED light source to the mounting frame.

In at least one additional embodiment of the present disclosure, a method for installing a lighting system in a ceiling grid is provided. The method comprising the steps of: installing a rectangular or square mounting frame in a rectangular or square grid opening in a ceiling grid; attaching a first longitudinal edge of the LED light source with a first side of the mounting frame; attaching a second longitudinal edge of the LED light source with a second side of the mounting frame; and wherein the first side of the mounting frame is parallel with the second side of the mounting frame and the first longitudinal edge of LED light source is parallel with the second longitudinal edge of LED light source.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are, therefore, not to be considered limiting of its scope, the disclosure will be described with additional specificity and detail through use of the following figures, which are idealized, are not to scale and are intended to be merely illustrative of aspects of the present disclosure and non-limiting. In the drawings, like elements are depicted by like reference numerals. The drawings are briefly described as follows:

Figure 8:
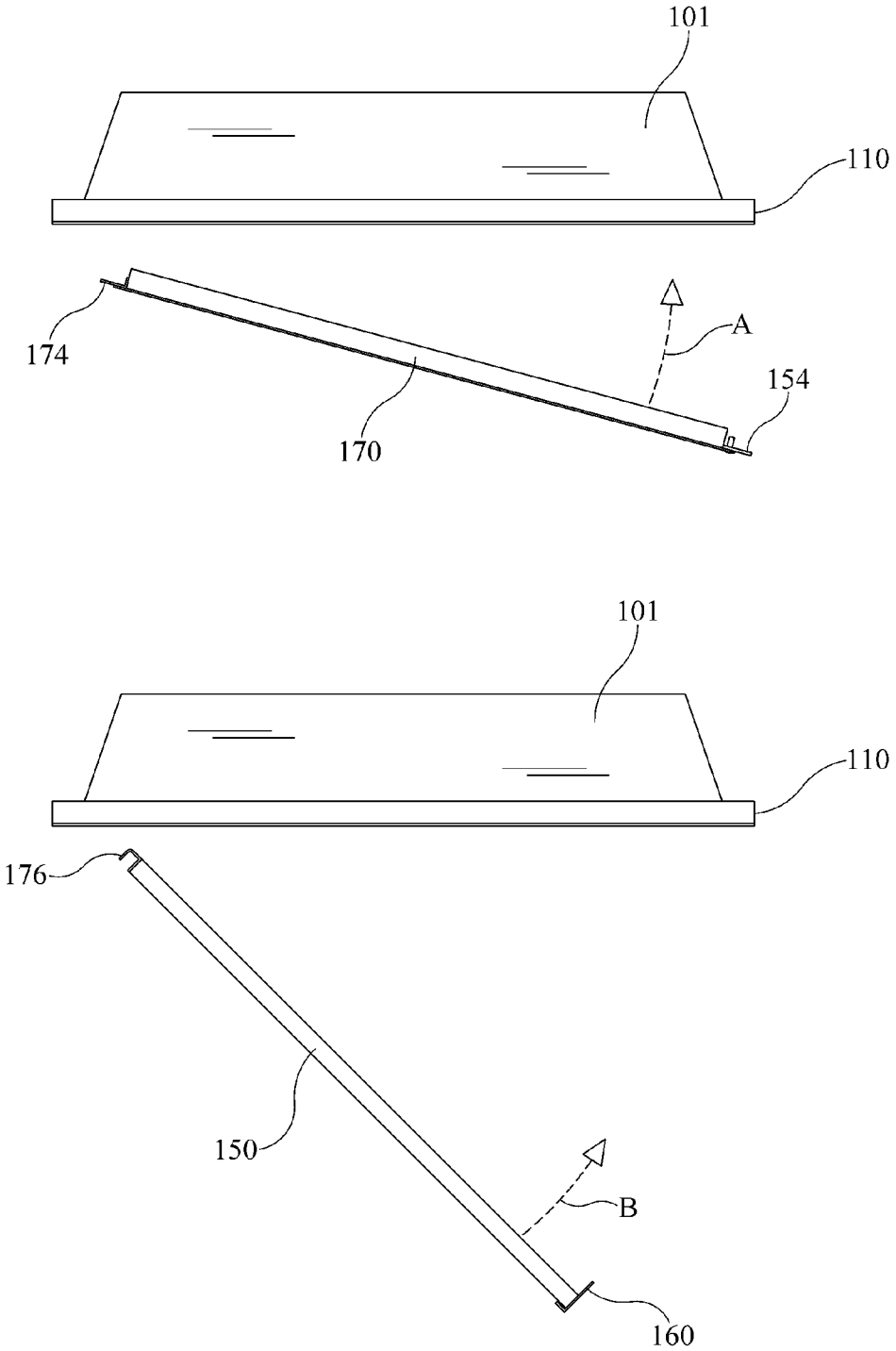
Figure 9:
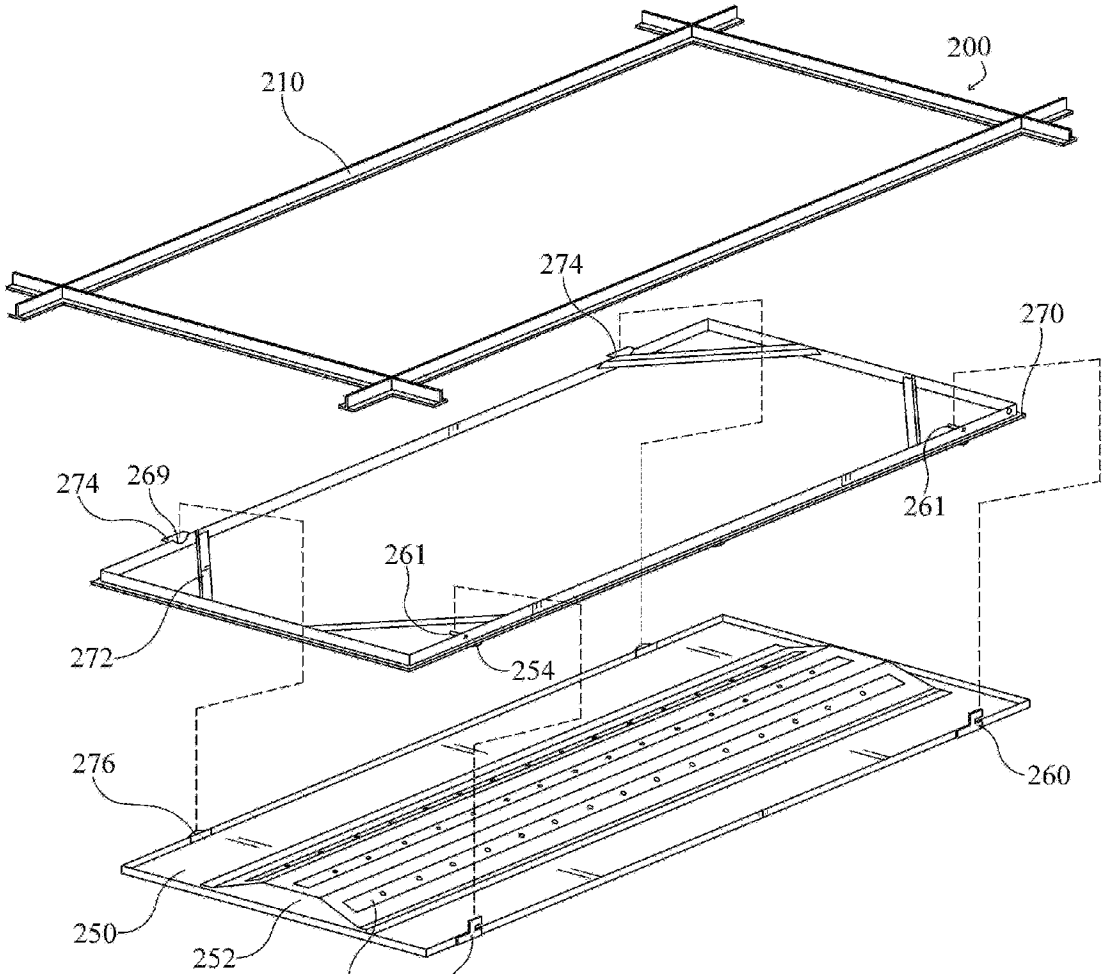

FIG. 8 graphically shows a method of installation of the presently disclosed lighting system in a ceiling grid; and FIG. 9 is a perspective view of an alternative embodiment of the lighting system configured to be mounted with a ceiling grid.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This present disclosure addresses issues associated with ceiling support grid lighting systems. Embodiments of the present disclosure may provide light source that enables easy, or less laborious, installation, or retrofitting, of a light source. The lighting system of the present disclosure may be installed by placing a mounting frame on the ceiling support grid and installing a light source with the mounting frame.

The mounting frame may be configured to be inserted into a ceiling grid opening and held therein. For example, the mounting frame may have holders in the form of flat fixed tabs that may be laid on a flange of the grid. These holders may be inserted between the flange and an existing installed troffer for retrofitting the existing troffer luminaire. The opposite side of the mounting frame may then be placed into the ceiling grid and a retractable holder may be extended to cooperate with the opposite side flange of the ceiling support grid.

Upon installation of the mounting frame in the ceiling support grid opening, an LED light source may be installed. For example, one side of the light source may have fixed extension(s) configured to cooperate with the mounting frame and the opposite side may have clasps configured to clasp to the mounting frame. The LED light source may have a low profile, enabling it fit into an existing troffer for retrofitting. For example, the LED light source may be in the form of a planar panel or have shallow formations in a panel with LED lights.

Figure 1:
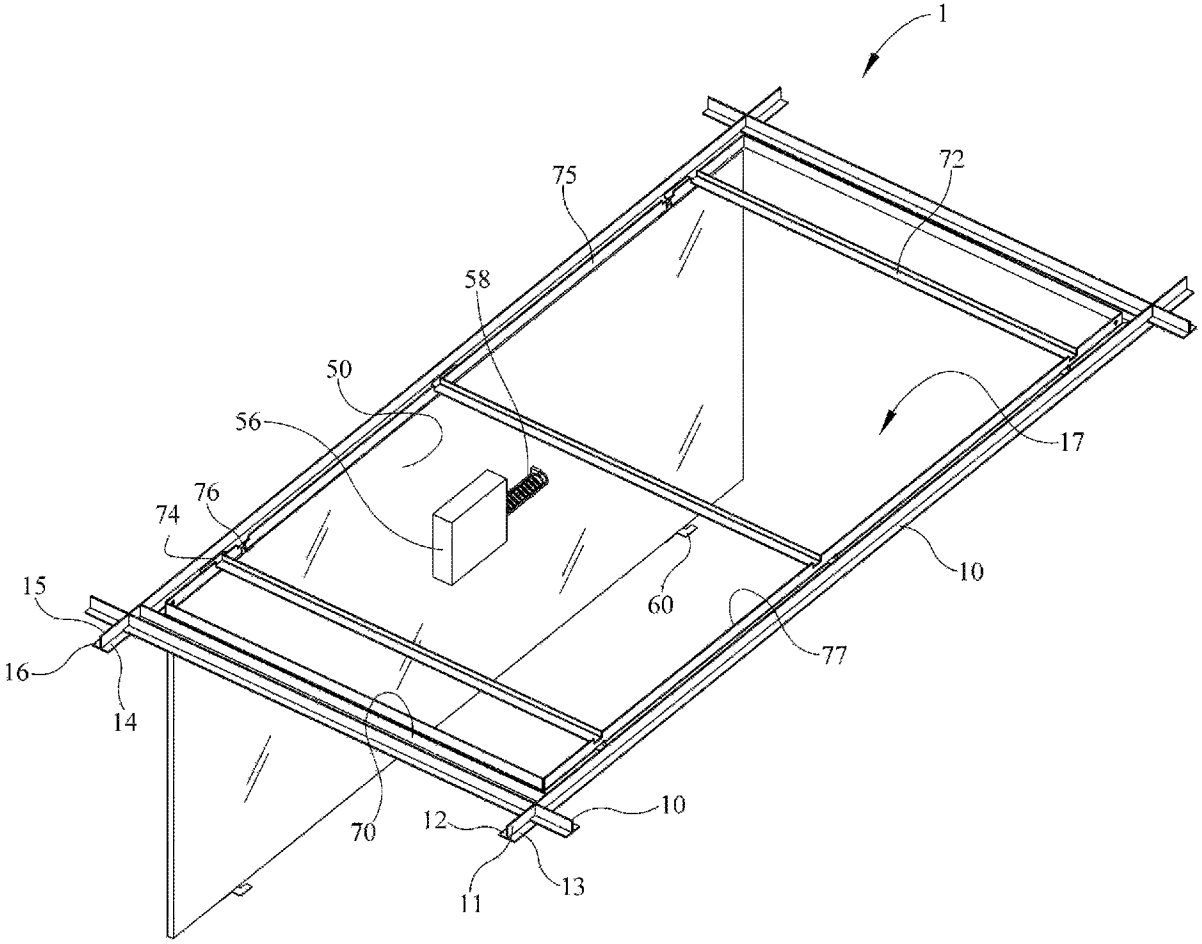
FIG. 1 is a perspective view of a lighting system configured to be mounted with a ceiling grid.

FIG. 1 is a perspective view of an illustrative example of the presently disclosed lighting system 1 configured to be mounted with a ceiling grid. Ceiling support grid 10 comprises at least one rectangular or square grid opening 17 with a first longitudinal flange 14 extending inward from a first side and a second longitudinal flange 12 extending inward from a second side. First flange 14 and second flange 12 are parallel with one another. Ceiling support grid 10 may have a "T" shaped cross section. For example, ceiling grid support 10 may have a first side with inward extending flange 14, upward extending flange 15, and outward extending flange 16, and a second side with inward extending flange 12, upward extending flange 11, and outward extending flange 13.

Lighting system 1 has a rectangular or square mounting frame 70 configured to transform its outer perimeter from a first outer perimeter to a second outer perimeter. The first outer perimeter has at least one holder and enables mounting frame 70 to fit into the ceiling support grid and have the at least one holder 74 cooperate with the first longitudinal flange 14. The second outer perimeter enables the mounting frame to cooperate with the second longitudinal flange 12 and to be held with the ceiling support grid 10.

A rectangular or square light LED light source 50 is configured to be held to mounting frame 70. LED light source 50 has at least one extension 76 extending from a first longitudinal edge and at least one clasp 60 on a second longitudinal edge. The first longitudinal edge of LED light source 50 is parallel with the second longitudinal edge of LED light source 50. The at least one extension 76 is configured to cooperate with mounting frame 70 and the at least one clasp 60 is configured to clasp with mounting frame 70.

Mounting frame 70 may have one or more cross-members 72 extending from its first side to its second side. In at least one embodiment, at least one clasp 60 is configured and disposed to clasp to a cross-member 72. LED light source 50 may be a planar light panel. However, it is to be understood that LED light source 50 may have other configurations as are known in the art.

The presently disclosed lighting system 1 may comprise an electrical driver 56 which may be configured to be mounted proximate to, or on, LED light source 50. A coiled cord 58 may be in electrical communication with electrical driver 56 which may have an electrical connector, such as a quick connect. For example, electrical driver 56 may be magnetically mountable and may be magnetically on the non-light emitting side of light source 50. A magnetically mountable electrical driver 56 may also be mounted proximate light source 50, for example in a troffer being retrofitted with the presently disclosed lighting system.

Figure 2:
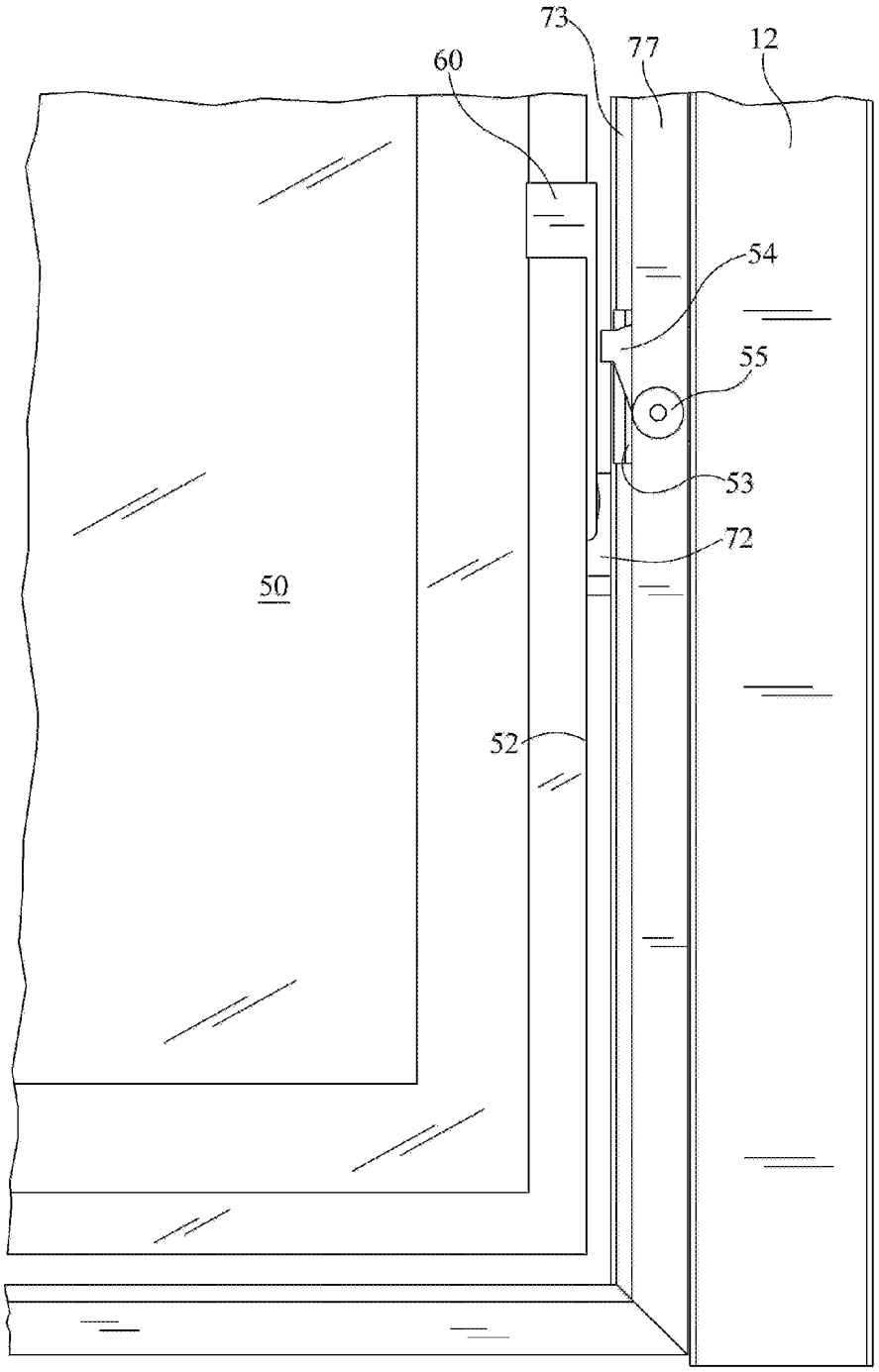
FIG. 2 is a lower cut-away view of the lighting system shown in FIG. 1, showing an illustrative example of a retractable holder in cooperation with a ceiling support grid and an illustrative example of a clasp in cooperation with a mounting frame.

FIG. 2 shows a lower cut-away view of lighting system 1 of the present disclosure showing an illustrative example of a retractable holder 54. Retractable holder 54 is shown an extended orientation and in cooperation with ceiling support grid 10, having second inward extending flange 12. For example, retractable holder 54 may be configured and disposed to retract into, and extend out of, a slot 53 in a side edge 73 of mounting frame 70. Retractable holder 54 may be rotatably mounted to frame 70 with pin 55. It is to be understood that upward extending side edge 73 may not be required.

Also shown in FIG. 2 is an illustrative example of clasp 60 in cooperation with mounting frame 70. For example, clasp 60 may be configured and disposed to clasp to at least one cross-member 72, extending between extending between the first and second sides, 75 and 77, of mounting 70.

Figure 3:
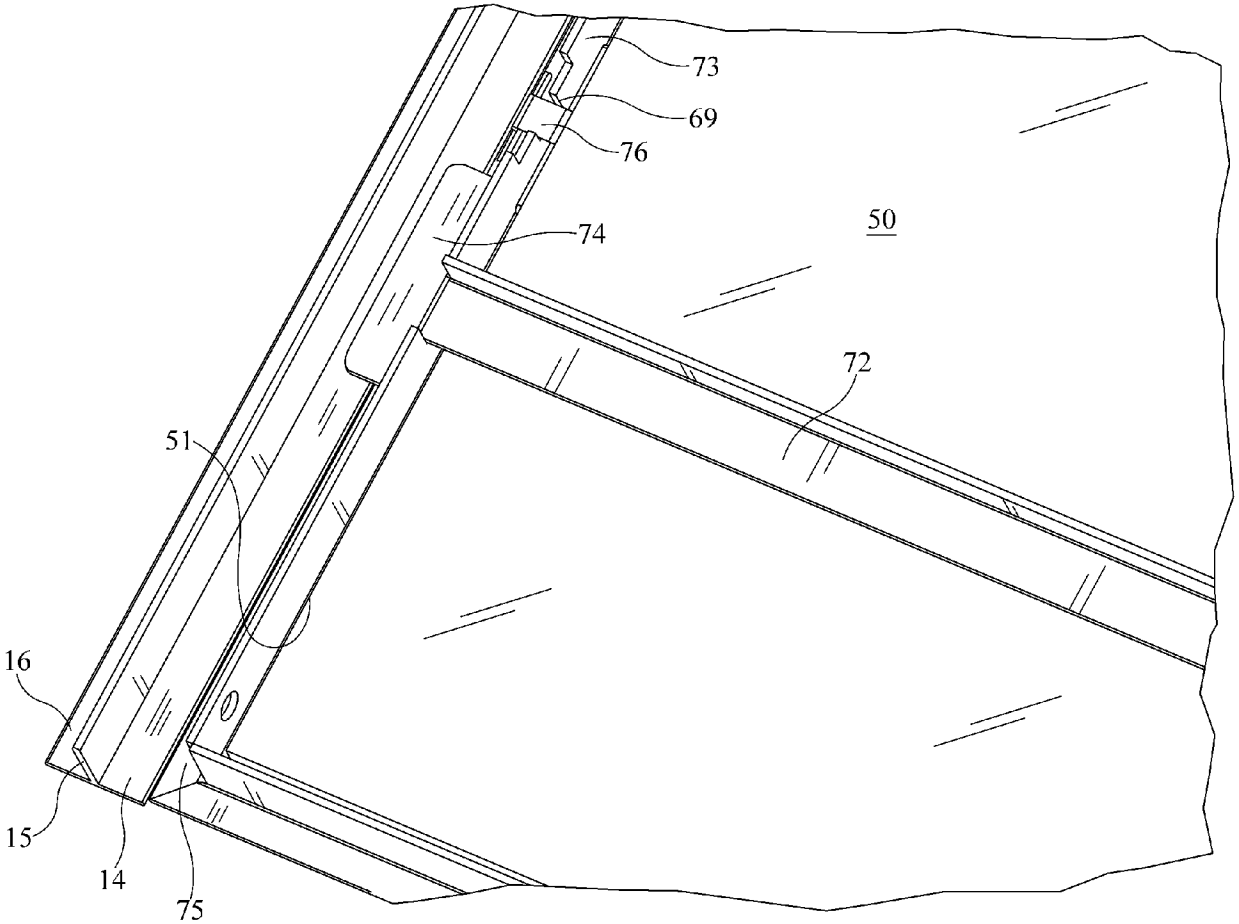
FIG. 3 is an upper cut-away view of the lighting system shown in FIG. 1, showing an illustrative example of a holder in cooperation with the ceiling support grid and an illustrative example of an extension in cooperation with the support frame.

FIG. 3 shows an upper cut-away view of the lighting system 1. An illustrative example of holder 74 is shown in cooperation with first inwardly extending flange 14, of ceiling support grid 10. Holder 74 may have a fixed flat tab extending outwardly from first side 75 of mounting frame 70. In at least one embodiment, frame 70 has upward extending edge 73 with an angular portion of holder 74 mounted thereto. A one cross-member 72 may extend from first side 75, of mounting frame 70, proximate holder 74.

FIG. 3 also shows an illustrative example of extension 76 in cooperation with support frame 70. Extension 76 extends from a first side edge 51, of light source 50, and may comprise a hook configured and disposed to hang LED light source 50 from mounting frame 70 and to pivot it about the hook.

Figure 4:
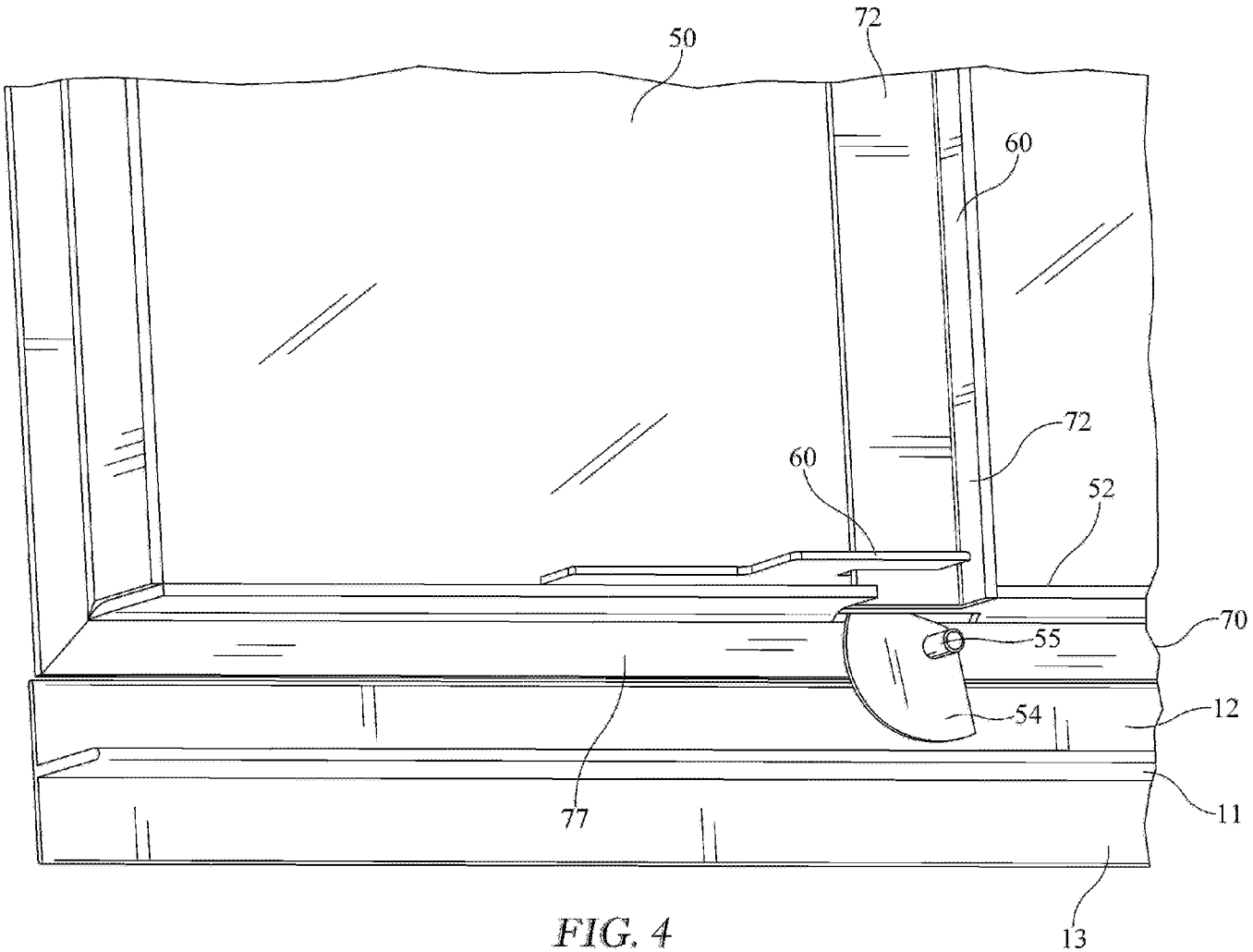
FIG. 4 is an upper cut-away view of the lighting system shown in FIG. 1, showing the illustrative retractable holder in cooperation with the ceiling support grid and the illustrative clasp in cooperation with the mounting frame.

FIG. 4 is an upper cut-away view of lighting system 1 showing the illustrative retractable holder 54 in cooperation with ceiling support grid 10 and illustrative clasp 60 in cooperation with mounting frame 70. Mounting frame 70 has the at least one retractable holder 54 proximate, or on, second side 77. Retractable holder 54 is rotatably mounted on second side 77, with pin 55, and is in an extended orientation, configuring mounting frame with a second, or larger, outer perimeter. The extension of retractable holder 54 may cooperate it with second inward extending longitudinal flange 12 by resting on it. In this illustrative embodiment, clasp 60 is clasp to cross-member 72. In at least one embodiment, retractable holder 54 may be configured and disposed to block clasping of clasp 60, upon the retraction of retractable holder 54. This may provide lighting system 1 with a safety feature, requiring the extension of retractable holder 54 to enable the clasping of clasp 60 with frame 70.

FIGS. 1 through 4 show at least one embodiment of lighting system 1 having mounting frame 70 with at least one holder 74 extending from a first side 75 and at least one retractable holder 54 proximate a second side 77. First side 75 and second side 77 are parallel. Retraction of retractable holder 54 configures mounting frame 70 with a first outer perimeter and the extension of retractable holder 54 configures mounting frame 70 with a second outer perimeter. Rectangular or square mounting frame 70 may be configured to transform its outer perimeter from the first outer perimeter to the second outer perimeter. The first outer perimeter may have at least holder 74 and enable mounting frame 70 to fit into opening 17, of ceiling support grid 10, and have at least one holder 74 cooperate with first longitudinal flange 14 of ceiling support grid 10. The second outer perimeter may be obtained by extending retractable holder 54 and may enable the mounting frame 70 to cooperate with second longitudinal flange 12 and hold mounting frame 70 with the ceiling support grid 10.

In at least one embodiment of the present disclosure, lighting system 1 is configured to be mounted with a ceiling grid 10. Ceiling support grid 10 may comprise at least one rectangular or square grid opening 17 with a first longitudinal flange 14 extending inward from a first side and a second longitudinal flange 12 extending inward from a second side, the first flange 14 and the second flange 12 are parallel with one another. Rectangular or square mounting frame 70 is configured to be mounted in rectangular or square grid opening 17.

Rectangular or square LED light source 50 is configured to be held to mounting frame 70. LED light source 50 may have at least one extension 76 extending beyond a first longitudinal edge 51 and at least one clasp 60 on a second longitudinal edge. The first longitudinal edge 51 and the second longitudinal edge 52 of light source 50 are parallel. The at least one extension 76 may be configured to hang LED light source 50 from mounting frame 70 and to pivot it about the at least one extension 76. The at least one clasp 60 may be configured to clasp with mounting frame 70 and hold LED light source 50 to the mounting frame.

Rectangular or square mounting frame 70 may comprise at least one cross-member 72 extending from a first side to a second side, the first and second sides being parallel. At least one clasp 60 may be disposed with LED light source 50, clasp 60 may be configured to clasp to a cross-member 72, or other part of mounting frame 70.

Figure 5:
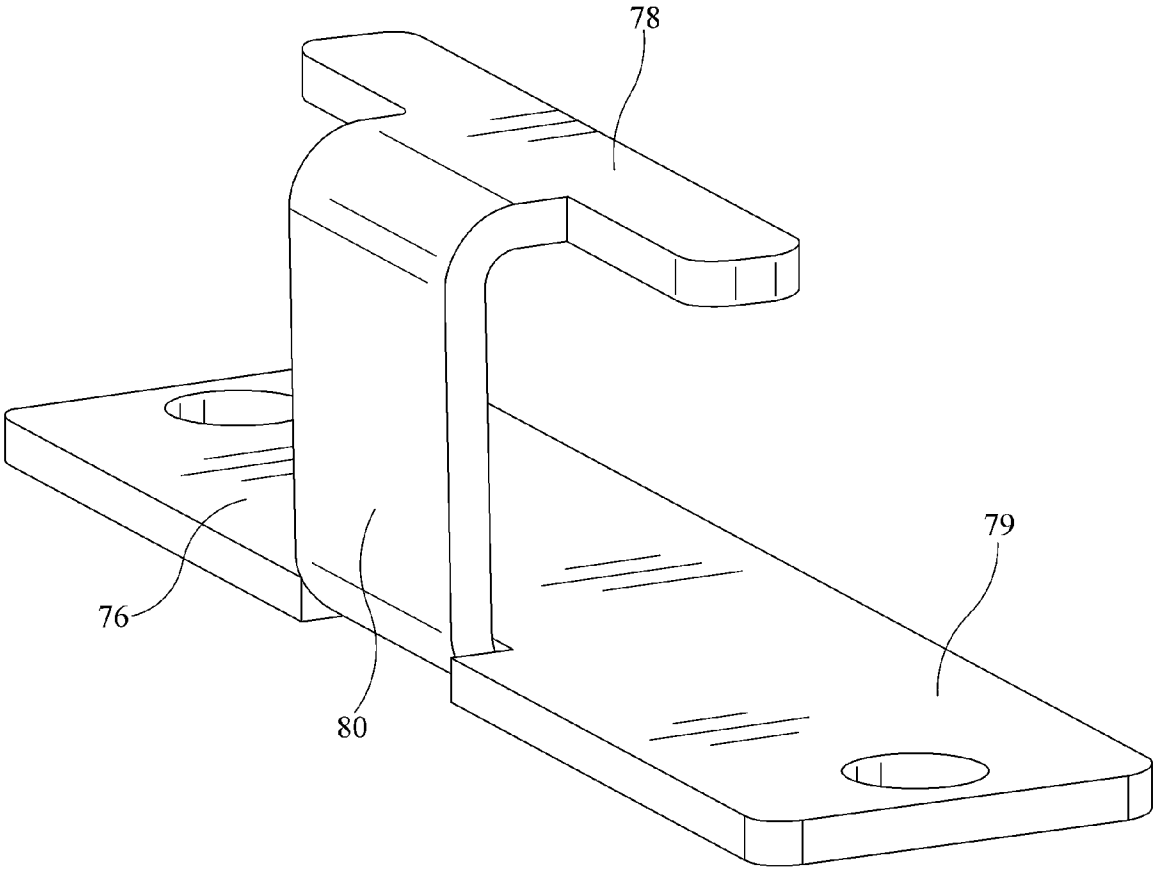
FIG. 5 is a perspective view of the illustrative extension shown in FIG. 3.

FIG. 5 is a perspective view of an illustrative extension 76 of the present disclosure. At least one extension 76 may extend from a side edge of LED light source 50, for example first side edge 51. Extension 76 is configured and disposed to hold first side edge 51 of LED light source 50 to mounting frame 70. Extension 76 may have a hook configuration and enable LED light source 50 to hang from mounting frame 70 and pivot about extension 76. For example, extension 76 may have a mounting plate 79 with apertures for mounting to an edge of LED light source 50. Hanger arm 80 may extend perpendicularly from mounting plate 79 and have hanger 78 on an end thereof. Hanger 78 may extend from hanger arm 80 and may be curved from hanger arm 80. Hanger 78 may have outward extensions configured to be inserted into a slot 69, in mounting frame 70. Upon a rotation of LED light source 50, the outward extensions on hanger 78 may be held in slot 69, holding extension 76 with mounting frame 70.

Figure 6:
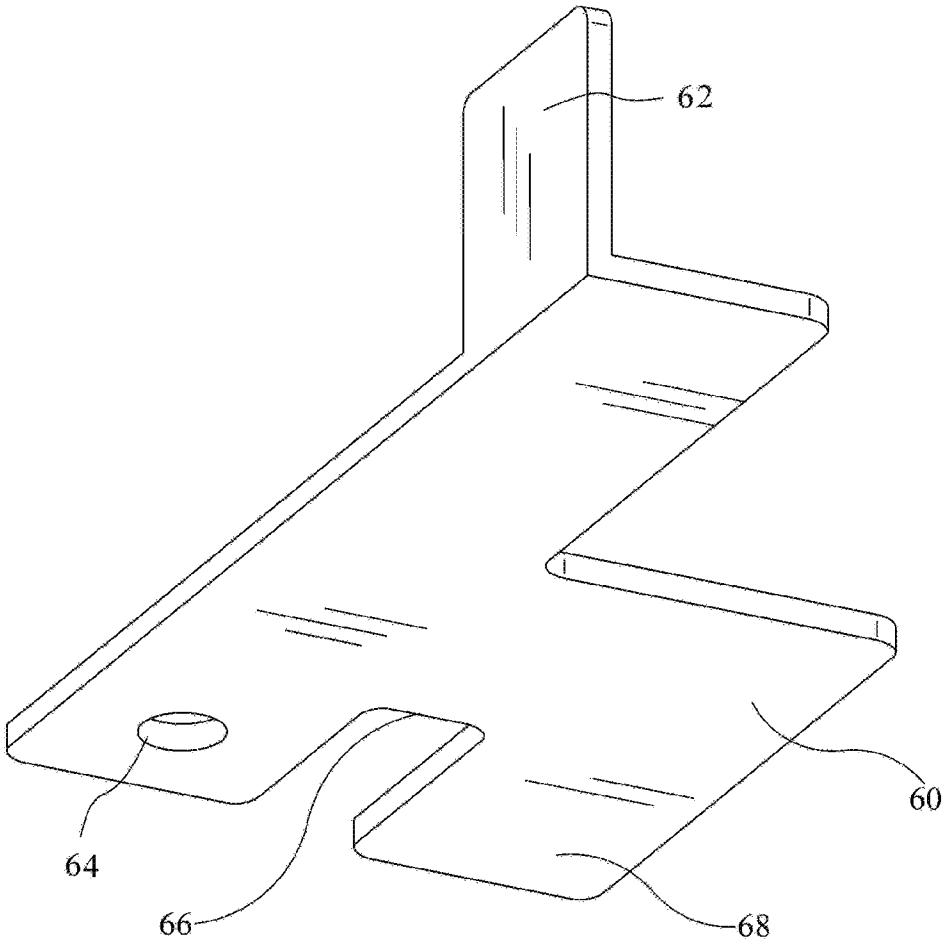
FIG. 6 is a perspective view of the illustrative clasp shown in FIG. 4.

FIG. 6 is a perspective view of clasp 60. Clasp 60 may be rotatably attached, at aperture 64, to a second edge 52 of light source 50. Clasp 60 may be configured to clasp on a portion of mounting frame 70 upon its rotation about aperture 64. For example, clasp 60 may have notch 66 configured and disposed to clasp and hold a cross-member 72. Clasp 60 may have a stop 62 configured and disposed to become substantially adjacent LED light source 50 upon clasping onto a portion of mounting frame 70. Clasping arm 68 may be configured and disposed with LED light source 50 to contact an extended retractable holder 54 and prevent clasping until retractable holder is extended.

Figure 7:
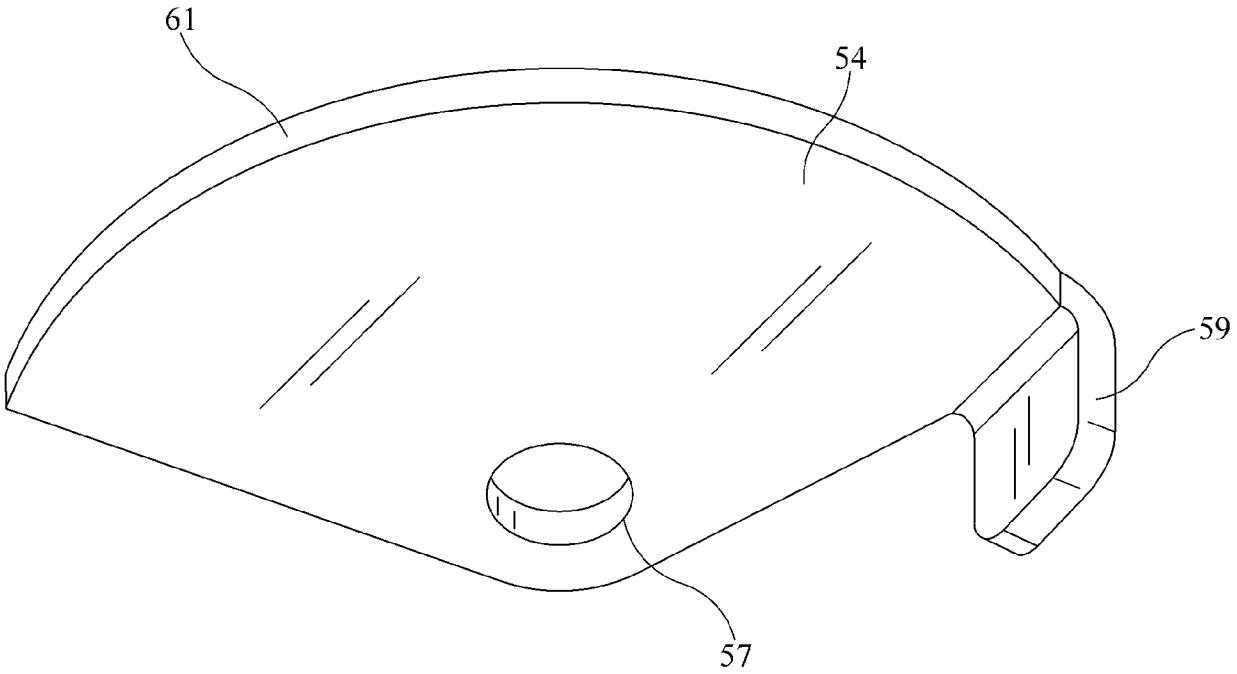
FIG. 7 is a perspective view of the illustrative retractable holder shown in FIG. 4.

FIG. 7 is a perspective view of the illustrative retractable holder 54. Retractable holder 54 may be configured to be rotatably attached to second side 77 of mounting frame 70. For example, a pin 55 may be extended through aperture 57 and hold retractable holder 54 to mounting frame 70. Retractable holder 54 may have a holding arm 61 extending outwardly from aperture 57. In at least one embodiment, holding arm 61 is configured to prevent clasp 60 from clasping until retractable holder 54 is rotated into an extended orientation. For example, holding arm 61 may be in the form of a circular segment. Retractable holder 54 may have a stop 59 on holding arm 61, stop 59 may be configured and disposed to become adjacent mounting frame 70, or frame edge 73, upon its extension.

In at least one embodiment, mounting frame 70 has at least one holder 74 extending from a first side and at least one retractable holder 54 proximate a second side, the first side and the second side are parallel, retraction of retractable holder 54 configures mounting frame 70 with a first outer perimeter and the extension of retractable holder 54 configures mounting frame 70 with a second outer perimeter, wherein the second outer perimeter is greater than the first outer perimeter.

FIG. 8 schematically shows a method of installation of the presently disclosed lighting system in a ceiling grid. The lighting system shown in FIG. 8 comprises a mounting frame 170 and an LED light source 150. Mounting frame 170 is configured to be placed into a ceiling grid opening and installed with ceiling grid 110, as shown in the upper drawing. LED light source 150 is configured to be placed into mounting frame 170 and held therein. Mounting frame 110 and LED light source 150 may be configured to be installed without removal of existing light troffer 101, providing a lighting system and method for retrofitting. For example, holder 174 may be configured and disposed to fit between troffer 101 and a flange extending inward from ceiling grid 110 and retractable holder 154 may be configured and disposed to extend between troffer 101 and a flange on the opposite side of ceiling grid 110.

A method for installing a lighting system in a ceiling grid may comprise installing a rectangular or square mounting frame 170 in a rectangular or square grid opening in ceiling grid 110. Mounting frame 170 may be installed by laying holder 174 on an inwardly extending flange on ceiling support grid 110 and pivoting the other end of mounting frame 170 up into ceiling support grid 110, as depicted by arrow "A". In at least one embodiment, holder 174 is a fixed flat tab. Upon pivoting mounting frame 170 upward into ceiling grid panel 110, retractable holder 154 may be extended outwardly from mounting frame 170 and laid on an inward extending flange of ceiling grid 110.

Upon installing mounting frame 170 into ceiling grid 110, LED light source 150 may be installed into mounting frame 170, as depicted in the lower drawing. This may comprise attaching a first longitudinal edge of LED light source 150 with a first side of mounting frame 170 by attaching extension 176 to a first side of mounting frame 170. In at least one embodiment, extension 176 is configured to hingedly hang LED light source 150 with mounting frame 170. LED light source 150 may pivoted about extension 176, as depicted by arrow "B", and the second side of LED light source 150 may be fit in mounting frame 170. A second longitudinal edge of the LED light source 150 may then be attached to a second side of mounting frame 170. For example, clasp 160 may be clasped onto mounting frame 170.

FIG. 9 is a perspective view of an alternative embodiment of the lighting system configured to be mounted with a ceiling grid, lighting system 200. Lighting system 200 has mounting frame 270 configured to be mounted with ceiling grid support 210. Mounting frame 270 has four sides, each having an "L" shaped cross-section. Cross-members 272 extend between adjacent perpendicular sides of mounting frame 270. One side has at least one holder 274 extending outward therefrom and an opposite side has at least one retractable holder 254. Holder(s) 274 are configured to rest on ceiling support grid 210 and retractable holder(s) 254 are configured to extend outward, from a retracted orientation, and rest on ceiling support grid 210.

Mounting frame 270 is also configured to have LED light source 250 mounted therewith. In at least one illustrative example, on one side, mounting frame 270 has notch 269 in an upward extending flange, and on an opposite side, mounting frame has 270 has pins 261 extending inward from an upward extending flange.

LED light source 250 is configured to be mounted with mounting frame 270. LED light source 250 has an LED holding portion 252, which may be in the form of an upward bump out portion or shallow troffer like portion. LED holding portion 252 may hold arrays of LEDs 248 on a lower lighting side of LED light source 250. At least one extension 276 extends outward from one side of LED light source 250. Extension(s) 276 may configured and disposed to cooperate with mounting frame 270 at notch 269. In at least one embodiment, extension(s) 276 have a curved hook like portion configured to hook onto the upward flange of mounting frame 270, about notch 269. On a side of LED light source, opposite the side having extension(s) 276, at least one clasp 260 is rotatably held therewith. Clasp(s) 260 are configured and disposed to clasp to pins 261, on mounting frame 270, and hold light source 250 to mounting frame 270.

There is thus provided a lighting system for a ceiling support grid. One feature or aspect of an illustrative example is believed at the time of the filing of this patent application to possibly reside broadly in a lighting system configured to be mounted with a ceiling support grid: the ceiling support grid comprising at least one rectangular or square grid opening with a first longitudinal flange extending inward from a first side and a second longitudinal flange extending inward from a second side, wherein the first flange and the second flange are parallel with one another; the lighting system comprising: a rectangular or square mounting frame configured to transform its outer perimeter from a first outer perimeter to a second outer perimeter, wherein the first outer perimeter has at least one holder and enables the mounting frame to fit into the ceiling support grid and have the at least one holder cooperate with the first longitudinal flange, the second outer perimeter enables the mounting frame to cooperate with the second longitudinal flange and to be held with the ceiling support grid; and a rectangular or square light LED light source configured to be held to the mounting frame comprising: at least one extension extending from a first longitudinal edge: at least one clasp on a second longitudinal edge; wherein the first longitudinal edge and the second longitudinal edge are parallel; and the at least one extension being configured to cooperate with the mounting frame and the at least one clasp being configured to clasp with the mounting frame.

Another feature or aspect of an illustrative example is believed at the time of the filing of this patent application to possibly reside broadly in a lighting system wherein the at least one extension comprises at least one hook configured and disposed to hang the LED light source from the mounting frame and to pivot it about the at least one hook.

Still another feature or aspect of an illustrative example is believed at the time of the filing of this patent application to possibly reside broadly in a lighting system wherein the mounting frame has the has the at least one holder extending from a first side and at least one retractable holder proximate a second side, the first side and the second side are parallel, retraction of the retractable holder configures the mounting frame with the first outer perimeter and the extension of the retractable holder configures the mounting frame with the second outer perimeter.

A further feature or aspect of an illustrative example is believed at the time of the filing of this patent application to possibly reside broadly in a lighting system further comprising at least one cross-member extending between the first side and the second side, or between adjacent perpendicular sides, of the mounting frame.

Another feature or aspect of an illustrative example is believed at the time of the filing of this patent application to possibly reside broadly in a lighting system wherein the at least one clasp is configured and disposed to clasp to the at least one cross-member.

A further feature or aspect of an illustrative example is believed at the time of the filing of this patent application to possibly reside broadly in a lighting system further comprising at least one pin extending inward from the second side of the mounting frame, wherein the at least one clasp is configured and disposed to clasp to the at least one pin.

Yet another feature or aspect of an illustrative example is believed at the time of the filing of this patent application to possibly reside broadly in a lighting system wherein the at least one retractable holder is configured and disposed to block clasping of the at least one clasp, upon the retraction of retractable holder.

Still another feature or aspect of an illustrative example is believed at the time of the filing of this patent application to possibly reside broadly in a lighting system wherein the at least one holder comprises at least one fixed flat tab.

Another feature or aspect of an illustrative example is believed at the time of the filing of this patent application to possibly reside broadly in a lighting system further comprising an electrical driver mounted on the LED light source.

Yet another feature or aspect of an illustrative example is believed at the time of the filing of this patent application to possibly reside broadly in a lighting system further comprising a coiled cord in electrical communication with the electrical driver.

One feature or aspect of an illustrative example is believed at the time of the filing of this patent application to possibly reside broadly in a lighting system wherein the electrical driver is magnetically mounted on the LED light source.

Another feature or aspect of an illustrative example is believed at the time of the filing of this patent application to possibly reside broadly in a lighting system being configured to retrofit a troffer light source, wherein the LED light source has a planar or shallow configuration, the at least one holder is configured and disposed to fit between the troffer and the first flange, and the at least one retractable holder is configured and disposed to extend between the troffer and the second flange.

Yet another feature or aspect of an illustrative example is believed at the time of the filing of this patent application to possibly reside broadly in a lighting system configured to be mounted with a ceiling grid comprising: the ceiling support grid comprising at least one rectangular or square grid opening with a first longitudinal flange extending inward from a first side and a second longitudinal flange extending inward from a second side, wherein the first flange and the second flange are parallel with one another; a rectangular or square mounting frame configured to be mounted in the rectangular or square grid opening; a rectangular or square LED light source configured to be held to the mounting frame comprising: at least one extension extending beyond a first longitudinal edge: at least one clasp on a second longitudinal edge; wherein the first longitudinal edge and the second longitudinal edge are parallel; the at least one extension being configured to hang the LED light source from the mounting frame and to pivot it about the at least one extension; and the at least one clasp being configured to clasp with the mounting frame and hold the LED light source to the mounting frame.

Still another feature or aspect of an illustrative example is believed at the time of the filing of this patent application to possibly reside broadly in a lighting system wherein the rectangular or square mounting frame comprises at least one cross-member extending between two of its sides.

A further feature or aspect of an illustrative example is believed at the time of the filing of this patent application to possibly reside broadly in a lighting system wherein the at least one clasp is configured and disposed to clasp to the at least one cross-member.

Another feature or aspect of an illustrative example is believed at the time of the filing of this patent application to possibly reside broadly in a method for installing a lighting system in a ceiling grid comprising the steps of: installing a rectangular or square mounting frame in a rectangular or square grid opening in a ceiling grid; attaching a first longitudinal edge of the LED light source with a first side of the mounting frame; attaching a second longitudinal edge of the LED light source with a second side of the mounting frame; and wherein the first side of the mounting frame is parallel with the second side of the mounting frame and the first longitudinal edge of LED light source is parallel with the second longitudinal edge of LED light source.

Yet another feature or aspect of an illustrative example is believed at the time of the filing of this patent application to possibly reside broadly in a method for installing a lighting system in a ceiling grid wherein the step of attaching a first longitudinal edge of the LED light source with a first side of the mounting frame comprises hingedly hanging the first longitudinal edge of the LED light source from the first longitudinal edge of the mounting frame.

Still another feature or aspect of an illustrative example is believed at the time of the filing of this patent application to possibly reside broadly in a method for installing a lighting system in a ceiling grid wherein the step attaching the second longitudinal edge of the LED light source with the second side of the mounting frame comprises: pivoting the LED light source about its first longitudinal edge and aligning the second longitudinal edge of the LED light source with the second side of the mounting frame; and clasping the second longitudinal edge of the LED light source to the mounting frame.

A further feature or aspect of an illustrative example is believed at the time of the filing of this patent application to possibly reside broadly in a method for installing a lighting system in a ceiling grid wherein the step of clasping comprises clasping the second longitudinal edge of the LED light source to a cross-member or pin extending from the side of the mounting frame.

One feature or aspect of an illustrative example is believed at the time of the filing of this patent application to possibly reside broadly in a method for installing a lighting system in a ceiling grid wherein the step of installing a rectangular or square mounting frame in a rectangular or square grid opening in a ceiling grid comprises installing the mounting frame between an existing troffer and the ceiling grid.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

AT LEAST PARTIAL NOMENCLATURE

1 lighting system
10 ceiling support grid
11 second upward extending longitudinal flange
12 second inward extending longitudinal flange
13 second outward extending longitudinal flange
14 first inward extending longitudinal flange
15 first upward extending longitudinal flange
16 first outward extending longitudinal flange
17 grid opening
50 LED light source
51 first side edge of LED light source
52 second side edge of LED light source
53 slot
54 retractable holder
55 pin
56 electrical driver
57 aperture
58 coiled cord
59 stop
60 clasp
61 holding arm
62 tab
64 aperture
66 notch
68 clasping arm
69 slot
70 rectangular or square mounting frame
72 cross-member
73 frame edge
74 holder
75 first side of mounting frame
76 extension
77 second side of mounting frame
78 hanger
79 mounting plate
80 hanger arm
101 troffer
110 ceiling support grid
150 LED light source
154 retractable holder
160 clasp
170 rectangular or square mounting frame
174 holder
176 extension
200 lighting system
210 ceiling support grid
248 LED array
250 LED light source

252 LED holding portion
254 retractable holder
260 clasp
261 pin
269 notch
270 mounting frame
272 cross-member
274 holder
276 extension

The invention claimed is:

1. A lighting system configured to be mounted with a ceiling support grid:

the ceiling support grid comprising at least one rectangular or square grid opening with a first longitudinal flange extending inward from a first side and a second longitudinal flange extending inward from a second side, wherein the first flange and the second flange are parallel with one another;

the lighting system comprising:

a rectangular or square mounting frame comprising a first side, a second side, a third side and a fourth side, wherein each of the sides are joined at terminal ends to form the rectangular or square mounting frame;

at least one cross-member extending between the first side and the second side, third side, or fourth side of the mounting frame;

the mounting frame being configured to transform an outer frame perimeter from a first outer perimeter to a second outer perimeter, wherein the first outer perimeter of the mounting frame has at least one holder extending from the first side of the mounting frame and enables the mounting frame to fit into the ceiling support grid and have the at least one holder cooperate with the first longitudinal flange, the second outer perimeter enables the mounting frame to cooperate with the second longitudinal flange and to be held with the ceiling support grid; and a rectangular or square LED light source configured to be held to the mounting frame comprising:

at least one extension extending from a first longitudinal edge:

at least one clasp located on a second longitudinal edge;

wherein the first longitudinal edge and the second longitudinal edge are parallel; and the at least one extension being configured to cooperate with the mounting frame and the at least one clasp being configured to clasp with the mounting frame.

2. The lighting system of claim 1, wherein the at least one extension comprises at least one hook configured and disposed to hang the LED light source from the mounting frame and to pivot 4 the LED light source about the at least one hook.

3. The lighting system of claim 1, wherein the at least one clasp is configured and disposed to clasp to the at least one cross-member.

4. The lighting system of claim 1 further comprising at least one pin extending inward from the second side of the mounting frame, wherein the at least one clasp is configured and disposed to clasp to the at least one pin.

5. The lighting system of claim 1, wherein the at least one holder comprises at least one fixed flat tab.

6. The lighting system of claim 1, wherein the mounting frame has at least one retractable holder proximate the second side of the mounting frame, the first side and the second side of the mounting frame are parallel, retraction of the retractable holder configures the mounting frame with the first outer perimeter and the extension of the retractable holder configures the mounting frame with the second outer perimeter.

7. The lighting system of claim 6, wherein the at least one retractable holder is configured and disposed to block clasping of the at least one clasp, upon the retraction of retractable holder.

8. The lighting system of claim 6 being configured to retrofit a troffer light source, wherein the LED light source has a planar or shallow configuration, the at least one holder is configured and disposed to fit between the troffer and the first flange, and the at least one retractable holder is configured and disposed to extend between the troffer and the second flange.

9. The lighting system of claim 1 further comprising an electrical driver mounted on the LED light source.

10. The lighting system of claim 9 further comprising a coiled cord in electrical communication with the electrical driver.

11. The lighting system of claim 9, wherein the electrical driver is magnetically mounted on the LED light source.

12. A lighting system configured to be mounted with a ceiling support grid comprising:

the ceiling support grid comprising at least one rectangular or square grid opening with a first longitudinal flange extending inward from a first side and a second longitudinal flange extending inward from a second side, wherein the first flange and the second flange are parallel with one another;

a rectangular or square mounting frame comprising a first side, a second side, a third side, and a fourth side, at least one cross-member extending between two respective said sides of the mounting frame, wherein each of the sides are joined at terminal ends to form the rectangular or square mounting frame, the mounting frame being configured to be mounted in the rectangular or square grid opening;

a rectangular or square LED light source configured to be held to the mounting frame comprising:

at least one extension extending beyond a first longitudinal edge:

at least one clasp located on a second longitudinal edge;

wherein the first longitudinal edge and the second longitudinal edge are parallel;

the at least one extension being configured to hang the LED light source from the mounting frame and to pivot the LED light source about the at least one extension; and the at least one clasp being configured to clasp with the mounting frame and hold the LED light source to the mounting frame.

13. The lighting system of claim 12, wherein the at least one clasp is configured and disposed to clasp to the at least one cross-member.

14. A method of installing the lighting system of claim 12 in the ceiling support grid comprising the steps of:

installing the rectangular or square mounting frame in the rectangular or square grid opening in the ceiling support grid;

attaching the first longitudinal edge of the LED light source with the first side of the mounting frame;

attaching the second longitudinal edge of the LED light source with the second side of the mounting frame; and wherein the first side of the mounting frame is parallel with the second side of the mounting frame.

15. The method of claim 14, wherein the step of installing the rectangular or square mounting frame in the rectangular or square grid opening in the ceiling support grid comprises installing the mounting frame between an existing troffer and the ceiling support grid.

16. The method of claim 14, wherein the step of attaching the first longitudinal edge of the LED light source with the first side of the mounting frame comprises hingedly hanging the first longitudinal edge of the LED light source from the first longitudinal edge of the mounting frame.

17. The method of claim 16, wherein the step attaching the second longitudinal edge of the LED light source with the second side of the mounting frame comprises:

pivoting the LED light source about the first longitudinal edge of the LED light source and aligning the second longitudinal edge of the LED light source with the second side of the mounting frame; and clasping the second longitudinal edge of the LED light source to the mounting frame.

18. The method of claim 17, wherein the step of clasping comprises clasping the second longitudinal edge of the LED light source to the cross-member or pin extending from the respective side of the mounting frame.

* * * * *